US005283297A

United States Patent [19]

Miyachi et al.

[11] Patent Number: 5,283,297

[45] Date of Patent: Feb. 1, 1994

[54] ARTIFICIAL HAIR FROM POLY AMINO ACID URETHANE FIBER

[75] Inventors: Yasuyoshi Miyachi; Nobuo Ito; Masako Koyama, all of Kanagawa, Japan

[73] Assignee: Aderans Co., Ltd., Tokyo, Japan

[21] Appl. No.: 831,579

[22] Filed: Feb. 7, 1992

[30] Foreign Application Priority Data

Feb. 13, 1991 [JP] Japan ..... 3-105247

[51] Int. Cl.[5] ..... C08G 18/60

[52] U.S. Cl. ..... 525/454; 525/420; 525/424; 525/459

[58] Field of Search ..... 525/454, 459, 420, 424

[56] References Cited

U.S. PATENT DOCUMENTS 4,767,827 8/1988 Iwatsuki et al. ..... 525/420

FOREIGN PATENT DOCUMENTS 1288401 9/1972 United Kingdom .

OTHER PUBLICATIONS

Patent Abstracts of Japan vol. 16 No. 437 (C-984)(5480) Sep. 11, 1992.

*Primary Examiner*—Harold D. Anderson
*Attorney, Agent, or Firm*—Nixon & Vanderhye

[57] ABSTRACT

An artificial hair made of a fibers comprising a poly-α-amino acid derivative insoluble to water and alcohols and represented by one of the following general formulae (1)-(4):

$$H(\underset{\underset{R}{|}}{NHCHCO})_nNHZ, \quad (1)$$

$$H(\underset{\underset{R}{|}}{NHCHCO})_nOZ, \quad (2)$$

$$H(\underset{\underset{R}{|}}{NHCHCO})_nNHZNH(\underset{\underset{R}{|}}{COCHNH})_mH \quad (3)$$

or $$N(\underset{\underset{R}{|}}{NHCHCO})_nOZO(\underset{\underset{R}{|}}{COCHNH})_mH, \quad (4)$$

providing that R in each of the above formula (1)-(4) is $R^a$, $R^b$ and $R^c$ represented, respectively, by the following general formula (5), (6) or (7):

$$\text{-}(CH_2)_kCONR^1(CH_2)_lNR^2R^3, \quad (5)$$

$$\text{-}(CH_2)_kCONR^1(CH_2)_lSR^2, \quad (6)$$

$$\text{-}(CH_2)_kCOOR', H, R'$$

or $$\text{-}CH_2CH_2SMe, \quad (7)$$

or made or polyamino acid urethane fiber comprising a copolymer of an amino acid N-carboxy anhydride and a polyurethane, in which the copolymer is subjected to an amidation reaction with an organic diamine and an organic amine having amino groups and mercapto groups or disulfide groups and to shaping into a fibrous form.

The artificial hair has a dyeability, shape retainability, natural and soft and flexible feeling, excellent tough and brushing property, as well as has natural color and gloss and toughness like that natural protein fiber.

11 Claims, No Drawings

ARTIFICIAL HAIR FROM POLY AMINO ACID URETHANE FIBER

BACKGROUND OF THE INVENTION

1. Field of the Invention

The present invention concerns an artificial hair comprising a fibrous poly-α-amino acid derivative or a polyamino acid urethane fiber carrying amino groups and mercapto or disulfide groups on the side chains of the polymer.

2. Description of the Prior Art

Poly-α-amino acids are similar, though they are synthetic polymers, to proteins in view of the chemical structure and have been studied long since as a model of in living body polymers. Further, studies have also been made for their application uses such as artificial skins, enzyme immobilization carriers, piezoelectric elements and cosmetics, in addition to the use of them as a substitute for generally used natural protein such as artificial leather and silk (refer to "Polyamino Acid-Application and Prospect", published, 1974 from Kodansha Co.).

A study has also been made for obtaining various functions from polyacidic amino acid ω-esters by converting pendant ester portions thereof through the reaction of ester-exchange or amidation (Journal of Polymer Science: Part C, Polymer Letters, 27, 399 (1989)). As its application example, there has been proposed an artificial hair that can be permed like that human hair starting from a poly-α-amino acid carrying mercapto or disulfide groups on the side chain (refer to Japanese Patent Laid-Open Sho 63-191829).

However, the poly-α-amino acid generally has a poor dyeability and it requires extremely complicate and troublesome dyeing steps for the artificial hair of setting by the combination of dyes at present in order to cope with various colors of human hair, which is disadvantageous in view of the cost as well.

Accordingly, a poly-α-amino acid carrying pendant amino groups and mercapto or disulfide groups and having a plurality of functions has been demanded as a material for the artificial hair.

Various natural protein fibers are identical to poly-α-amino acids in that they comprise proteins and are composed of various kinds of amino acids, but the natural protein fibers have an extremely complicate fine structure attributable to their constitution comprising various kinds of amino acids. Therefore, feeling and soft and flexible touch of the natural protein fibers can not be attained satisfactorily with synthetic fibers simply composed only of the poly-α-amino acid. Namely, the a poly-α-amino acid fiber is rigid and stiff in the feeling as compared with the natural protein fiber to give a problem, for example, in that feeling upon touch is unnatural when it is used as an artificial hair, different from that of the human hair and it can not be brushed smoothly. It is, therefore, demanded for a synthetic fiber which is mainly composed of a poly-α-amino acid and has a more natural and soft and flexible feeling and is excellent in the brushing property or the like.

OBJECT OF THE INVENTION

It is, accordingly, an object of the present invention to provide an artificial hair made of a fiber comprising a poly-α-amino acid derivative having a shape retainability after molding, capable of being dyed with an acidic dye and insoluble to water and alcohol.

Another object of the present invention is to provide an artificial hair made of a synthetic fiber mainly comprising a poly-α-amino acid having the natural and soft and flexible feeling and also excellent in the touch and the brushing property.

The present inventors have made an earnest study for attaining the foregoing objects and, as a result, have accomplished the present invention.

The first feature of the present invention is based on the finding that an artificial hair made of a fibrous poly-α-amino acid derivative carrying amino groups and mercapto or disulfide groups properly on the side chains of the polymer has a shape retainability and can be dyed with an acidic dye.

Specifically, the foregoing objects can be attained in accordance with the first aspect of the present invention by an artificial hair made of a fiber comprising a poly-α-amino acid derivative insoluble to water and alcohol and represented by one of the following general formulae (1)–(4):

$$H(\underset{\underset{R}{|}}{NHCHCO})_nNHZ \quad (1)$$

where Z represents an alkyl group with 1 to 6 carbon atoms, a tertiary amino alkyl group with 3 to 6 carbon atoms or H and n represents an integer of 50 to 4000, $$H(\underset{\underset{R}{|}}{NHCHCO})_nOZ \quad (2)$$

where Z represents an alkyl group with 1 to 6 carbon atoms or H and n represents an integer of 50 to 4000, $$H(\underset{\underset{R}{|}}{NHCHCO})_nNHZNH(\underset{\underset{R}{|}}{COCHNH})_mH \quad (3)$$

where Z represents an alkyl group with 1 to 6 carbon atoms and n+m represents an integer of 50 to 4000, $$H(\underset{\underset{R}{|}}{NHCHCO})_nOZO(\underset{\underset{R}{|}}{COCHNH})_mH \quad (4)$$

where Z represents an alkyl group with 1 to 6 carbon atoms and n+m represents an integer of 50 to 4000, providing that R in each of the above-mentioned formulae (1)–(4) is $R^a$, $R^b$ or $R^c$ represented, respectively, by the following general formula (5), (6) or (7), in which each of $R^a$ and $R^b$ is contained in R by more than 1 mol % and the sum for $R^a$ and $R^b$ contained in R is less than 55 mol %:

$$\text{-}(CH_2)_kCONR^1(CH_2)_lNR^2R^3 \quad (5)$$

where k represents 1 or 2, l represents an integer of 1 to 4, $R^1$, $R^2$ and $R^3$ each represents H or an alkyl group with 1 to 4 carbon atoms, $$\text{-}(CH_2)_kCONR^1(CH_2)_lSR^2 \quad (6)$$

where k represents 1 or 2, l represents an integer of 1 to 4, $R^1$ represents H or an alkyl group with 1 to 4 carbon atoms, $R^2$ represents H or $S(CH_2)_jNR^3R^4$ (in which j represents an integer of 1 to 4 and $R^3$ and $R^4$ each represents H or an alkyl group with 1 to 4 carbon atoms), and $R^b$ may be put to intramolecular and/or intermolecular crosslinking between each other by means of disulfide bondings or $$-(CH_2)_kCOOR', H, R' \quad \text{or} \quad -CH_2CH_2SMe \qquad (7)$$

where k represents 1 or 2 and R' represents an alkyl group with 1 to 4 carbon atoms or a benzyl group.

The poly-α-amino acid as the raw material for the poly-α-amino acid derivative to be used as the material for the artificial hair according to the present invention may be a homopolymer or a copolymer of an ω-ester of glutamic acid or aspartic acid or a copolymer of an ω-ester of glutamic acid and/or aspartic acid with a neutral α-amino acid such as glycine, alanine, valine, norvaline, leucine, phenylalanine and methionine. Further it may be a copolymer of an ω-ester of glutamic acid and/or aspartic acid with two or more of the above-mentioned neutral α-amino acids. They are hereinafter collectively referred to as the starting poly-α-amino acid.

In order that the fibrous poly-α-amino acid derivative as the material for the artificial hair according to the present invention has a sufficient strength and durability, it is necessary that the derivative has a degree of polymerization of at least 50 to 4000 and, preferably, 100 to 2000. For this purpose, it is desirable that the degree of polymerization of the starting poly-α-amino acid is from 50 to 10,000.

As the process for producing the starting poly-α-amino acid having such a molecular weight, a polycondensating process of amino acid N-carboxy anhydride has been completed and partially put into industrial use. The initiator for the polycondensating reaction can include a monoamine type initiator such as butylamine, ethylamine or ammonia, a mono-ol type initiator such as butanol, ethanol or water, a diamine type initiator such as hexamethylenediamine or ethylenediamine and a diol type initiator such as hexamethylene glycol or ethylene glycol.

For preparing a poly-α-amino acid derivative from the starting poly-α-amino acid thus produced, the starting poly-α-amino acid is put to a direct amidation reaction with an organic diamine and an organic amine having a mercapto or disulfide group. The poly-α-amino acid derivative obtained in this way is a novel substance.

The organic diamine is a diamine compound represented by the general formula:

$$HR^1N(CH_2)_nNR^2R^3 \qquad (8)$$

where n represents an integer of 1 to 4 and $R^1$, $R^2$ and $R^3$ each represents H or an alkyl group with 1 to 4 carbon atoms and it can include, for example, ethylenediamine, N-methyl-1,3-diaminopropane and N,N-dimethyl-1,3-diaminopropane. Further, the organic amine having the mercapto or disulfide group is an amine compound represented by the general formula:

$$HR^1N(CH_2)_mSR^2 \qquad (9)$$

where m represents an integer of 1 to 4, $R^1$ represents H or an alkyl group with 1 to 4 carbon atoms, $R^2$ represents H or $S(CH_2)_nNR^3R^4$ in which n represents an integer of 1 to 4, $R^3$ and $R^4$ each represents H or an alkyl group with 1 to 4 carbon atoms and the compound can include, for example, cysteamine or cystamine.

In the amidation described above, the starting poly-α-amino acid and the above-mentioned amines, i.e., the organic diamine and the organic amine are brought into the amidation in a homogeneous system. Specifically, the above-mentioned amines are added to a solution of the starting poly-α-amino acid and then reacted at a temperature ranging from room temperature to 100° C. for one hour to two days, preferably, at 40° to 60° C. for several hours as in usual organic reactions. In this case, a solvent which is a good solvent to the starting poly-α-amino acid and is not reactive with the amine is preferred and, specifically, it can include, for example, methylene chloride, tetrachloroethylene and trichloroethylene. After the reaction, the product is shaped into a fibrous form to obtain a fibrous poly-α-amino acid derivative as the raw material for the artificial hair according to the present invention.

Alternatively, the fibrous poly-α-amino acid derivative can also be prepared as shown below. After shaping the starting poly-α-amino acid into a fibrous form, it is immersed into a solution containing the above-mentioned amines dissolved therein, at a temperature ranging from a room temperature to 100° C. for one hour to one week, desirably, at 50° to 80° C. for 5 to 72 hours to conduct direct amidation. In this case, a solvent which is a poor solvent to the starting poly-α-amino acid after shaping into the fibrous form and is not reactive with the amine is preferred and, specifically, it can include, for example, methanol, ethanol, isopropanol, acetonitrile and dioxane. The concentration of the amine in the solution is from 0.1 to 70% by weight, preferably, 1 to 50% by weight.

The amidation reaction can be applied either by conducting the reaction in one step while using the organic diamine and the organic amine having the mercapto or disulfide group together or by conducting the reaction in two steps while using the organic diamine and the organic amine separately in each of the steps. By the amidation, an aimed poly-α-amino acid derivative carrying the amino groups and the mercapto or disulfide groups on the side chains can be obtained. In the case of the two step reactions, there is no particular restriction for the order of adding the organic diamine and the organic amine to be reacted with the poly-α-amino acid.

In order that the thus obtained fibrous poly-α-amino acid derivative shows an excellent dyeability to an acidic dye, it is required that amino groups necessary for the development of the dyeability are properly carried. For this purpose, among the fibrous poly-α-amino acid derivatives represented by the general formulae (1)–(4) described above, those fibrous poly-α-amino acid derivatives containing more than 1 mol % of $R^a$ represented by the general formula (5) in the side chain R are preferred. A poly-α-amino acid derivative with the content of $R^a$ of less than 1 mol % has insufficient amino groups and exhibits no practical dyeability.

Furthermore, in order that the fibrous poly-α-amino acid derivative according to the present invention exhibits an excellent shape retainability, it is necessary that mercapto or disulfide groups required for the development of the shape retainability are carried properly. For this purpose, among the fibrous poly-α-amino acid derivatives represented by the general formulae (1)–(4), those fibrous poly-α-amino acid derivatives containing more than one mol % of $R^b$ represented by the general formula (6) in the side chain R are preferred. A fibrous poly-α-amino acid derivative with the content of $R^b$ of less than 1 mol % has an insufficient number of intermolecular crosslinkings and exhibits no practical shape retainability.

Further, it is desirable that the sum for $R^a$ and $R^b$ in the side chain R of the fibrous poly-α-amino acid derivative represented by the general formulae (1)–(4) is less than 55 mol %. A fibrous poly-α-amino acid derivative containing $R^a$ and $R^b$ by more than 55 mol % in total carries excessive amino or mercapto groups and, accordingly, becomes soluble to water and alcohols, which can not be said suitable as the material for the artificial hair in view of the endurance or the like when it is used in the daily life.

The artificial hair comprising the fibrous poly-α-amino acid derivative according to the present invention is insoluble to water and alcohols. The alcohol mentioned herein includes methanol, ethanol, propanol and isopropanol.

Accordingly, the artificial hair according to the present invention is dyeable like that human hair and can cope with delicate tones of human hair which are different on every persons. Further, it also has an excellent nature of so-called well-permed property, capable of maintaining favorable wave of hair by once disconnecting intermolecular crosslinkings due to disulfide bondings with a first liquid for permanent (reducing agent), setting the hair to a preferred form of wave and then applying intermolecular cross-linkings again by means of disulfide bondings using a second liquid for permanent (oxidizing agent).

As described above, since the poly-α-amino acid derivative according to the present invention carries the amino groups on the side chain of the polymer, it can be dyed optionally to a desired color by an acidic dye and, since the derivative carries the mercapto or disulfide groups, it can provide a shape retainability by applying re-crosslinking between molecules by means of the disulfide bondings through a redox reaction and, accordingly, a fibrous shaping product made of the above-mentioned material can provide an excellent artificial hair.

Next, the foregoing object of the present invention can be attained also by a polyamino acid urethane fiber as the material for the artificial hair, which constitutes a second feature of the present invention.

That is, the present inventors have developed a polyamino acid urethane fiber which is structurally similar, though it is a synthetic polymer, to natural protein fibers, has a dyeability and a shape retainability, as well as has extremely natural feeling and is also excellent in touch, brushing property or the like, and have accomplished the present invention of another feature based on such development.

It is necessary for the polyamino acid urethane resin as the material for the polyamino acid urethane fiber to make the artificial hair according to the present invention that it has sufficient strength and durability to be spun into a fibrous form or formed into a film and then cut into a fibrous shape.

The polyamino acid urethane fiber as the material for the artificial hair according to the present invention comprises a copolymer of a polyurethane and an amino acid N-carboxy anhydride, in which the copolymer is subjected to an amidation reaction with an organic diamine represented by the following general formula (10) and an organic amine having a mercapto or disulfide group represented by the following general formula (11) or the following general formula (12) and shaping into a fibrous form:

$$HR^1N(CH_2)_nNR^2R^3 \quad (10)$$

where n represents an integer of 1 to 4 and $R^1$, $R^2$ and $R^3$ each represents H or an alkyl group with 1 to 4 carbon atom, $$HR^1N(CH_2)_mSH \quad (11)$$

where m represents an integer of 1 to 4 and $R^1$ represents H or an alkyl group with 1 to 4 carbon atoms, and $$HR^1N(CH_2)_mSS(CH_2)_nNR^2R^3 \quad (12)$$

where m and n each represents an integer of 1 to 4 and $R^1$, $R^2$ and $R^3$ each represents H or an alkyl group with 1 to 4 carbon atoms.

In the present invention, the polyamino acid urethane fiber can be formed, either (a) by copolymerizing the polyurethane and the amino acid N-carboxy anhydride and then subjecting the resultant copolymer to amidation with the organic diamine represented by the general formula (10) and the organic amine having the mercapto or disulfide group represented by the general formula (11) or (12), to form a polyamino urethane resin, which is then shaped into a fibrous form, or (b) by copolymerizing the polyurethane and the amino acid N-carboxy anhydride, shaping the resultant copolymer into a fibrous form and, thereafter, subjecting the resultant fiber to amidation with the organic diamine represented by the general formula (10) and the organic amine having the mercapto or disulfide group represented by the general formula (11) or (12).

The polyamino acid urethane fiber prepared as described above comprises a novel substance.

The polyamino acid urethane resin as the raw material for the polyamino acid urethane fiber according to the present invention is prepared by mixing, in an organic solvent not having active hydrogen, an acidic amino acid ω-alkyl N-carboxy anhydride represented by the following general formula (13):

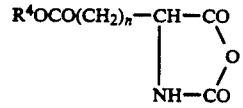

(13)

where n represents 1 or 2 and $R^4$ represents an alkyl group with 1 to 4 carbon atoms or a benzyl group, with a polyurethane and, optionally, a neutral amino acid N-carboxy anhydride represented by the following general formula (14):

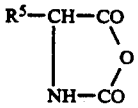

(14)

where $R^5$ represents an alkyl group with 3 and 7 carbon atoms or a benzyl group, and then polymerizing them.

The organic solvent not having active hydrogen can include, for example, a halogen type solvent such as 1,2-dichloroethane, chloroform or methylene chloride, an amide type solvent such as N,N-dimethylformamide, formamide and N-methylpyrrolidone, a ketone type solvent such as methyl ethyl ketone and acetone, an ether type solvent such as dioxane and diglyme, an aromatic type solvent such as benzene and toluene, an ester type solvent such as ethyl acetate and butyl acetate. They may be used alone or as a mixture.

Typical examples of the acidic amino acid ω-alkyl N-carboxy anhydride, there can be mentioned amino acid N-carboxy anhydrides such as γ-methyl glutamate, γ-benzyl glutamate, β-methyl aspartate and β-benzyl aspartate. The acidic amino acid γ-alkyl N-carboxy anhydrides may be used alone or as a mixture.

Typical examples of the neutral amino acid N-carboxy anhydride can include, for example, amino acid N-carboxy anhydride such as of glycine, leucine, valine and alanine and such neutral amino acid N-carboxy anhydrides may be used alone or as a mixture.

As the polyurethane, those having terminal isocyanate groups or terminal amino groups can be used. Specifically, a polyurethane having terminal isocyanate groups used herein is obtained by reacting a polyester diol, polyether diol, polycarbonate diol, lacton ring-opened diol, alone or as a mixture of them is optionally incorporated with a low molecular weight diol such as ethylene glycol or 1,4-butane-diol, to which an organic diisocyanate such as an aromatic diisocyanate, an aliphatic diisocyanate and a cycloaliphatic diisocyanate. The polyurethane having terminal amino groups used herein is obtained by reacting an organic diamine such as an aromatic diamine, an aliphatic diamine or a polyether diamine, with the polyurethane having terminal isocyanate groups as described above.

An aimed polyamino acid urethane resin can be obtained by mixing the acidic amino acid ω-alkyl N-carboxy anhydride, the polyurethane having terminal isocyanate groups and the neutral amino acid N-carboxy anhydride in an organic solvent having no active hydrogen and then adding amines to conduct copolymerization. The amines used herein are organic diamine such as an aromatic diamine, an aliphatic diamine and a polyether diamine. In this case, a tertiary amine such as polymethylamine, triethylamine or tributylamine may be used together as required.

Further, the aimed polyamino acid urethane resin can also be obtained by mixing the acidic amino acid γ-alkyl N-carboxy anhydride, the polyurethane having the terminal amino group and the neutral amino acid N-carboxy anhydride in an organic solvent having no active hydrogen, to conduct copolymerization. In this case, a tertiary amine may be used together as required.

The polyamino acid urethane fiber as the raw material for the artificial hair according to the present invention has a natural and flexible feeling and touch, which are similar to those of the natural protein fibers. For attaining this, it is desirable for that the content of the polyurethane in the amino acid N-carboxy anhydride and the polyurethane is from 5 to 50% by weight upon preparing the amino acid urethane resin of the raw material by the polymerizing reaction. If the polyurethane is less than 5% by weight, the effect of the polyurethane is insufficient and the feeling is not natural but rigid. On the other hand, if the polyurethane is greater than 50% by weight, the toughness and natural color and gloss of the polyamino acid are degraded and the feeling becomes rather unnatural.

In the polyamino acid urethane fiber, the amino groups and the mercapto or disulfide groups are carried by subjecting the ester groups on the side chains of the polymer to the amidation, so that it is dyeable with an acid dye and has a shape retainability like that the natural protein fiber. For attaining this, it is necessary that the content of the acidic amino acid ω-alkyl N-carboxy anhydride in the amino acid N-carboxy anhydride and the polyurethane is greater than 2% by weight and, particularly preferably, greater than 10% by weight upon preparing the polyamino acid urethane resin as the raw material through polymerizing reaction. If the acidic amino acid ω-alkyl N-carboxy anhydride is less than 2% by weight, the amount of the ester groups undergoing the amidation is insufficient and, accordingly, the resultant fiber exhibits no practical dyeability with the acidic dye and shape retainability.

There is no particular restriction on the temperature for the polymerization but, in view of the reaction control or the like, it is within a range from 10° to 60° C., preferably, 20° to 40° C. Further, the resin concentration upon polymerization is appropriately from 3 to 40% by weight since too high concentration makes the viscosity of the solution remarkably high to render the handling difficult. In particular, resin concentration within a range from 5 to 25% by weight can provide a solution of a starting polyamino acid urethane resin having a viscosity extremely easy to handle with.

Since the polyamino acid urethane fiber according to the present invention carries the amino group and the mercapto or disulfide groups on the side chains of the polymer, it can be dyed with an acidic dye and has a satisfactory shape retainability quite in the same way as in the natural protein fiber. The polyamino acid urethane fiber carrying the amino groups and the mercapto or disulfide groups on the side chains can be prepared by subjecting the starting polyamino acid urethane resin as described above to amidation with an organic diamine and an organic amine having a mercapto or disulfide group. The organic diamine is a diamine compound represented by the general formula (10) described above and it can include, for example, ethylenediamine, N-methyl-1,3-diaminopropane and N,N-dimethyl-1,3-diaminopropane. Further, the organic diamine having the mercapto or disulfide group is an amine compound represented by the general formula (11) or (12) described above, which can include, for example, cysteamine or cystamine.

The amidation reaction may be conducted either by directly subjecting the starting polyamino acid urethane resin to the amidation with the amines (organic diamine and the organic amine described above) in a homogeneous system, or by shaping the starting polyamino acid urethane resin into a fibrous form and then subjecting it to the amidation with the above-mentioned amines. In the former method, the amine are added to a solution of the starting polyamino acid urethane resin and then reacting them at a temperature ranging from a room temperature to 100° C. for one hour to two days, preferably, at 40° to 60° C. for several hours as in the usual organic reactions, to obtain the aimed polyamino acid urethane resin. In this case, a solvent which is a good solvent to the starting polyamino acid urethane resin but not reactive with the amines is preferred and, more specifically, it can include, for example, chloroform, methylene chloride, tetrachloroethylene and trichloroethylene. Subsequently, the polyamino acid urethane fiber according to the present invention can be obtained by shaping the reaction product into a fibrous form. In the latter method, the starting polyamino acid urethane resin is at first shaped into a fibrous form by a conventional method and, subsequently, the fiber is immersed and reacted in a solution containing the amines dissolved therein at a temperature ranging from a room temperature to 100° C. for one hour to one week, preferably, at 50° to 80° C. for 5 to 72 hours. In this case, a solvent which is a poor solvent to the fibrous starting polyamino acid urethane resin and not reactive with the amines is preferred and it can include, for example, water, methanol, ethanol, acetonitrile and dioxane. The concentration of the amines in the solution is from 0.1 to 70%, preferably, 1 to 50%. Among the two methods described above, the latter method is a more convenient method since the polyamino acid urethane fiber according to the present invention can be obtained by merely rinsing the product with water or methanol for the purification after the reaction.

In the amidation reaction, the organic diamine and the organic amine having the mercapto or disulfide group may be added at once to conduct the reaction in one step, or they may be added separately to conduct the reaction in two steps. In the case of the two step reaction, there is no particular restriction on the order of adding the organic diamine and the organic amide for the reaction.

The polyamino acid urethane fiber according to the present invention can be spun in the same manner as in the case of the poly-α-amino acid by the method as disclosed in Japanese Patent Publication Sho 43-28787. Similarly, it may be once taken up in the form of a film or powder from the solution of the polyamino acid urethane resin according to the present invention.

As described above, the polyamino acid urethane fiber according to the present invention, when it is used as an artificial hair as a substitute for the natural protein fiber, is chemically similar, though it is a synthetic fiber, to the human hair and has natural toughness and color and luster. Further, it has a soft and flexible nature derived from the polyurethane ingredient and also excellent in the brushing property. Further, since it carrier the amino groups on the side chains of the polymer, it can be dyed with an acidic dye quite in the same manner as the human hair. In addition, since it carries the mercapto or disulfide groups on the side chains of the polymer, it can be permed quite in the same manner as the human hair.

As has been described above, the polyamino acid urethane fiber according to the present invention has a soft and flexible feeling similar to the natural protein fiber such as of human hair and silk. In addition, since it carries the amino groups and the mercapto or disulfide groups on the side chains of the polymer, it can be dyed with an acidic dye quite in the same manner as the natural protein fiber. Furthermore, since it has a shape retainability due to the intermolecular re-crosslinking through the redox reaction, it can provide an excellent artificial hair.

EXAMPLE

Description will now be made to the present invention by way of its examples for clearer understanding of the features of the present invention but it should be noted that the invention is not restricted only to these examples.

EXAMPLE 1

Synthesis for the Derivative (1)

50 μl of a dioxane solution containing 2.65M of N,N-dimethyl-1,3-diaminopropane was added to 37.4 g of γ-methyl-L-glutamic acid N-carboxy anhydride and 162 g of chloroform, and stirred at a room temperature for 12 hours. 4.09 g of N,N-dimethyl-1,3-diaminopropane and 3.08 g of cysteamine were added to 191 g of a chloroform solution of the resultant poly-γ-methyl-L-glutamate (PMG) (polymerization degree: 1200), and stirred at 60° C. for three hours to obtain a solution of poly-α-amino acid derivative (resin concentration: 15% by weight).

As a result of measurement for $^1$H-NMR, the amidation ratio was 35% in total.

EXAMPLE 2

Synthesis for the Derivative (2)

147 μl of a dioxane solution containing 2.65M of N,N-dimethyl-1,3-diaminopropane was added to 37.4 g of γ-methyl-L-glutamic acid N-carboxy anhydride, 45.9 g of L-leucine N-carboxy anhydride and 450 g of chloroform, and stirred at a room temperature for 12 hours, to conduct polymerization. 5.1 g of N,N-dimethyl-1,3-diamino-propane and 3.7 g of cysteamine were added to 511 g of a chloroform solution of the resultant γ-methyl-L-glutamate/L-leucine copolymer (polymerization degree: 1300), and stirred at 60° C. for 6 hours, to obtain a solution of poly-α-amino acid derivative (resin concentration: 13% by weight).

As a result of measurement for $^1$H-NMR, the amidation ratio was 45% in total.

EXAMPLE 3

Synthesis for the Derivative (3)

After cooling 37.4 g of γ-methyl-L-glutamic acid N-carboxy anhydride and 162 g of chloroform to 10° C. and adding 40 μl of a dioxane solution containing 2.65M of butanol and 0.1 g of triethylamine, they were stirred for 12 hours while elevating a temperature to a room temperature. 4.09 g of N,N-dimethyl-1,3-diaminopropane and 3.08 g of cysteamine were added to 191 g of a chloroform solution containing the resultant PMG (polymerization degree: 1000), and stirred at 60° C. for 3 hours, to obtain a solution of poly-α-amino acid derivative (resin concentration: 15% by weight).

As a result of measurement for $^1$H-NMR, the amidation ratio was 32% in total.

EXAMPLE 4

Synthesis for the Derivative (4)

30 μl of a dioxane solution containing 2.65M of ethylenediamine was added to 37.4 g of γ-methyl-L-glutamic acid N-carboxy anhydride and 162 g of chloroform, and stirred at a room temperature for 12 hours. 4.09 g of N,N-dimethyl-1,3-diaminopropane and 3.08 g of cysteamine were added to 191 g of a chloroform solution containing the resultant PMG (polymerization degree: 1100), and stirred at 60° C. for three hours, to obtain a solution of poly-α-amino acid derivative (resin concentration: 15% by weight).

As a result of measurement for $^1$H-NMR, the amidation ratio was 33% in total.

EXAMPLE 5

Synthesis for the Derivative (5)

After cooling 37.4 g of γ-methyl-L-glutamic acid N-carboxy anhydride and 162 g of chloroform to 10° C. and adding 30 μl of a dioxane solution containing 2.65M of ethylene glycol and 0.1 g of triethylamine, they were stirred for 12 hours while elevating a temperature to a room temperature. 4.09 g of N,N-dimethyl-1,3-diamino-propane and 3.08 g of cysteamine were added to 191 g of a chloroform solution containing the resultant PMG (polymerization degree: 950), and stirred at 60° C. for 3 hours, to obtain a solution of poly-α-amino acid derivative (resin concentration: 15% by weight).

As a result of measurement for $^1$H-NMR, the amidation ratio was 30% in total.

EXAMPLE 6

Artificial Hair (1)

50 μl of a dioxane solution containing 2.65M of N,N-dimethyl-1,3-diaminopropane was added to 37.4 g of γ-methyl-L-glutamic acid N-carboxy anhydride and 162 g of 1,2-dichloroethane (EDC) and stirred at a room temperature for 12 hours. The resultant EDC solution of PMG (polymerization degree: 1200) was spun under the conditions of nozzle diameter: 0.4 mmϕ, dope discharge rate: 0.86 ml/min (6.79 m/min), coagulation solvent: a mixture of tetrachloroethylene: kerosene (=3:1), and length of coagulation bath: 3 m, to obtain a fiber of a circular cross section sized 164 denier. 5 g of the PMG fiber stretched by 1.8 times was set to a frame and then subjected to amidation while being immersed in 50 ml of methanol, 1.5 g of N,N-dimethyl-1,3-diaminopropane and 7.5 g of cysteamine at 60° C. for 24 hours.

After washing twice each time with 30 ml of methanol, the fiber was dried to obtain a fibrous poly-α-amino acid derivative.

It was confirmed that the resultant fibrous poly-α-amino acid derivative showed excellent dyeability according to the following acidic dyeing test and also confirmed that it could be permed by the following permanent wave effect test. For the comparison, the poly-γ-methyl-L-glutamate fiber obtained in Japanese Patent Publication Sho 43-28787 and human virgin hair (hair taken from a girl of 10 years old) were also dyed and permed.

The results are shown in Table 1. Form the results of Table 1, it can be found that the fibrous poly-α-amino acid derivative could possess excellent performance when it was used as an artificial hair.

TABLE 1

| Fiber material | | Dyeability | Effect of permanent wave |
|---|---|---|---|
| Example 6 | | • | 3.6 |
| Comp. Example | PMG fiber | Δ | not permed |
| | Human hair | — | 3.3 |

Acidic Dyeing Test

The test as to whether or not the fiber showed a dyeability to an acidic dye was conducted as shown below.

The fiber or the film was immersed under no tension in a dyeing solution at 90° C. for one hour. Then, the fiber was washed with water and dried spontaneously.

The dyeability was evaluated as follows. That is, solid circle for dense color, blank circle for medium color, trigon for pale color to contamination and x for not dyed.

The dyeing solution had a composition comprising 2% by weight of a dye: Illugaran Black BGL (manufactured by Seiwa Co.) and 5% by weight of an auxiliary agent: anhydrous sodium sulfate.

Test for the Permanent Wave Effect

A test as to whether or not the fiber could be permed was conducted as below.

The fiber was wound around a rod under a tension of 70 g and immersed in a first liquid for permanent wave (6.5% aqueous solution of ammonium thioglycolate, adjusted with an aqueous ammonia to pH 9.2–9.6) for 15 min. Then, it was immersed in a second liquid for permanent wave (5% aqueous solution of sodium bromate). The fiber was detached from the rod, washed with water in a free state and dried spontaneously.

The effect of the permanent wave was determined according to the following equation:

$$\text{Effect of Permanent Wave} = \frac{\text{Wave length of wave after permanent treatment (mm)}}{\text{Diameter of rod used (mm)}}$$

EXAMPLE 7

Artificial Hair (2)

147 μl of a dioxane solution containing 2.65M of N,N-dimethyl-1,3-diaminopropane was added to 37.4 g of γ-methyl-L-glutamic acid N-carboxy anhydride, 45.9 g of L-leucine N-carboxy anhydride and 450 g of EDC and stirred at a room temperature of 12 hours for polymerization.

The EDC solution of the resultant γ-methyl-L-glutamate/L-leucine copolymer (polymerization degree: 1300) was spun, subjected to amidation and washed under the same conditions as those in Example 6, to obtain a fibrous poly-α-amino acid derivative.

The resultant fibrous poly-α-amino acid derivative exhibited a dyeability to dense color, the effect of the permanent wave was 3.9 and it has been found that the derivative had an excellent performance when it was used as an artificial hair.

EXAMPLE 8

Artificial hair (3)

After cooling 37.4 g of γ-methyl-L-glutamic acid N-carboxy anhydride and 162 g of EDC to 10° C. and adding 40 μl of a dioxane solution containing 2.65M of butanol and 0.1 g of triethylamine, they were stirred for 12 hours while elevating a temperature to a room temperature. The EDC solution of the resultant PMG (polymerization degree: 1000) was spun, subjected to amidation and washed under the same conditions as those in Example 6, to obtain a fibrous poly-α-amino acid derivative.

The resultant fibrous poly-α-amino acid derivative exhibited a dyeability to dense color, the effect of the permanent wave was 3.2 and it has been found that the derivative had an excellent performance when it was used as an artificial hair.

EXAMPLE 9

Artificial Hair (4)

30 μl of a dioxane solution containing 2.65M of ethylenediamine was added to 37.4 g of γ-methyl-L-glutamic acid N-carboxy anhydride and 162 g of EDC and stirred at a room temperature for 12 hours.

The EDC solution of the resultant PMG (polymerization degree: 1100) was spun, subjected to amidation and washed under the same conditions as those in Example 6, to obtain a fibrous poly-α-amino acid derivative.

The resultant fibrous poly-α-amino acid derivative exhibited a dyeability to a dense color, the effect of the permanent wave was 3.5 and it has been found that the derivative had an excellent performance when it was used as an artificial hair.

EXAMPLE 10

Artificial Hair (5)

After cooling 37.4 g of γ-methyl-L-glutamic acid N-carboxy anhydride and 162 g of EDC to 10° C. and adding 30 μl of a dioxane solution containing 2.65M of ethylene glycol and 0.1 g of triethylamine, they were stirred for 12 hours while elevating a temperature to a room temperature. The EDC solution of the resultant PMG (polymerization degree: 900) was spun, subjected to amidation and washed under the same conditions as those in Example 6, to obtain a fibrous poly-α-amino acid derivative.

The resultant fibrous poly-α-amino acid derivative exhibited a dyeability to a dense color, the effect of the permanent wave was 3.2 and it has been found that the derivative had an excellent performance when it was used as an artificial hair.

EXAMPLE 11

Artificial Hair (6)

A solution of the poly-α-amino acid derivative obtained in Example 1 was spun under the same conditions as those in Example 6 to obtain a fiber of a circular cross section sized 160 denier. The fiber was washed three times each time with 300 ml of water, dried and then stretched by 1.7 times to obtain fibrous poly-α-amino acid derivative.

Under the same conditions, fibrous poly-α-amino acid derivatives were obtained from the solutions of poly-α-amino acid derivatives obtained in Examples 2–5. It has been found that the resultant fibrous poly-α-amino acid derivatives had excellent performance according to the acidic dyeing test and the permanent wave effect test when they were used as the artificial hair.

Results are shown in Table 2.

TABLE 2

| Example of starting material | Dyeability | Effect of permanent wave |
|---|---|---|
| 1 | • | 3.7 |
| 2 | • | 4.0 |
| 3 | • | 3.3 |
| 4 | • | 3.7 |
| 5 | • | 3.6 |

Further, description will also be made to examples of the polyurethane amino acid fiber, but it should be noted that the present invention is not limited only to these examples.

EXAMPLE 12

(A) Preparation of Polyurethane having Terminal Isocyanate Groups

After charging 115 parts of a polycarbonate diol with an average molecular weight of 2000 in a polymerization vessel and adding 26 parts of isophorone diisocyanate, 0.08 parts of a 10% TN-12 toluene solution and 142 parts of toluene, they were reacted at 110° C. for 4 hours, to obtain a polyurethane having terminal isocyanate groups.

The polyurethane was accurately weighed by about 4 g in an Erlenmeyer flask and dissolved into 10 ml of tetrahydrofuran. Further, 5 ml of a 0.5N di-n-butylaminetoluene solution was added, stirred for 10 min, to which 80 ml of methanol was added and put to neutralizing titration with 0.5N hydrochloric acid. A blank was titrated in the same manner and, as a result of the quantitative determination for the terminal isocyanate groups, the isocyanate value of the polyurethane having terminal isocyanate groups was $0.84\times10^{-3}$ g equivalent.

(B) Preparation of Polyurethane Having Terminal Amino Groups

"Jefermine D-2000" (manufactured by Mitsui Texaco Chemical, average molecular weight: 2000) was dissolved by 39 g into 203 g of N,N-dimethylformamide, to which 86 g of a 50 wt % of polyurethane solution obtained in (A) was gradually added and reacted for 30 min to obtain a polyurethane having terminal amino groups.

About 10 g of the polyurethane obtained as above was accurately weighed in an Erlenmeyer flask, dissolved in 90 ml of N,N-dimethylformamide and then subjected to neutralizing titration with 0.05N hydrochloric acid. A blank was titrated in the same manner and, as a result of a quantitative determination for the terminal amino groups, the amine value of the polyurethane having terminal amino groups was $6.0\times10^{-5}$ g equivalent.

EXAMPLE 13

(A) Preparation of the Starting Polyamino Acid Urethane Resin

After adding 374 g of L-glutamic acid-γ-methyl N-carboxy anhydride and 2280 g of 1,2-dichloroethane to 56.8 g of a 50 wt % polyurethane solution obtained in Example 12 (A) and stirring for 10 min, 3.2 g of "Jefermine D-2000" and 0.9 ml of triethylamine were added and polymerized by stirring for 5 hours, to obtain a solution of a polyamino acid urethane resin (resin concentration: 12%).

(B) Preparation of Starting the Polyamino Acid urethane Resin 327 g of L-glutamic acid-γ-methyl N-carboxy anhydride, 1940 g of 1,2-dichloroethane and 2.6 ml of triethylamine were added to 111 g of the 25 wt % of polyurethane solution obtained in Example 12 (B), and polymerized by being stirred at 25° C. for 5 hours to obtain a solution of a polyamino acid urethane resin (resin concentration: 12%).

EXAMPLE 14

After filtering under pressure the starting polyamino acid urethane resin solution in Example 13 (A) to remove insoluble matters, it was spun under the conditions of nozzle diameter: 0.4 mmϕ, dope discharge rate: 0.86 ml/min (6.79 m/min), coagulation solvent: a mixture of tetrachloroethylene: kerosene (=3:1) and length of coagulation bath: 3 m. After drying the fiber, it was stretched by 1.8 times to obtain a polyamino acid urethane fiber. 5 g of the polyamino acid urethane fiber was wound around and set to a frame and immersed in 50 ml of methanol, 7.5 g of N,N-dimethyl-1,3-diaminopropane and 7.5 g of cysteamine for amidation. It was washed twice each time with 30 ml of methanol repeatedly and then dried.

It has been confirmed that the resultant polyamino acid urethane fiber had excellent feeling and brushing property by the following feeling and brushing test. It has further been confirmed that the fiber had an excellent dyeability according to the following acidic dyeing test. Furthermore, it has been confirmed that the fiber could be permed by the following permanent wave effect test. From the foregoing results, it has been found that the polyamino acid urethane fiber possessed an excellent performance when it was used as an artificial hair.

The results are shown in Table 3.

TABLE 3

| Sample | | Feeling | Brushing property | Permanent wave effect | Dyeability |
|---|---|---|---|---|---|
| Example 14 | | ○ | ○ | 3.9 | |
| Comp. Example | PMG fiber | x | Δ | not permed | Δ |
| | Human hair | ○ | ○ | 3.3 | — |

Feeling and Brushing Test

Using the resultant polyamino acid urethane fibers, hair pieces each of 11 cm length, 4 cm width and 4 g weight unified with respect to the size, weight and direction were prepared in accordance with the method of Sakamoto, et al (Journal of Japan Cosmetic Society, 8, 330 (1984)), and functional evaluation was made to the feeling and brushing property.

The evaluation was made according to the three step evaluation. That is, blank circle for excellent, trigon for ordinary and x for poor.

For the comparison, poly-γ-methyl-glutamate fiber obtained in Japanese Patent Publication Sho 43-28787 and human virgin hair (hair taken from a girl of 10 years old) were also put to the functional evaluation in the same manner.

Acidic Dyeing Test

A test as to whether or not the fibers exhibits a dyeability to an acidic dye was conducted as shown below.

The fibers were immersed under no tension in a dyeing solution at 90° C. Then, the fibers were washed with water and dried spontaneously.

The dyeability was evaluated as follows. That is, solid circle for dense color, blank circle for medium color, trigonal for pale color to contamination and x for not dyed.

For the comparison, poly-γ-methyl-glutamate fiber obtained in Japanese Patent Publication Sho 43-28787 and a human virgin hair (hair taken from a girl of 10 years old) were also subjected to dyeing evaluation in the same manner.

The dyeing solution had a composition comprising 2% by weight of a dye: Illugaran Black BGL (manufactured by Seiwa Co.) and 5% by weight of an auxiliary agent: anhydrous sodium sulfate.

Permanent Wave Effect Test

A test as to whether or not the fiber could be permed was conducted as below.

The fiber was wound around a rod under a tension of 70 g, and immersed into a first liquid for permanent wave (6.5% aqueous solution of ammonium thioglycolate, adjusted with an aqueous ammonia to pH 9.2–9.6) for 15 min. Then, it was immersed in a second liquid for permanent wave (5% aqueous solution of sodium bromate). The fiber was detached from the rod, washed with water in a free state and dried spontaneously.

The effect of the permanent wave was determined according to the following equation:

$$\text{Effect of Permanent Wave} = \frac{\text{Wave length of wave after permanent treatment (mm)}}{\text{Diameter of rod used (mm)}}$$

For the comparison, the poly-γ-methyl-glutamate fiber obtained in Japanese Patent Publication Sho 43-28787 and a human virgin hair (hair taken from a girl of 10 years old) were also evaluated for the effect of the permanent wave.

EXAMPLE 15

After filtering under pressure the starting polyamino acid urethane resin solution in Example 13(B) to remove insoluble matters, it was spun, dried, stretched, subjected to amidation and dried in the same procedures as those in Example 14.

It has been found that the resultant polyamide acid urethane fiber was excellent both in the feeling and the brushing property, exhibited dyeability to a dense color, had an effect of permanent wave of 3.8 and had an excellent performance when it was used as the artificial hair.

EXAMPLE 16

After adding 187 g of L-glutamic acid-γ-methyl N-carboxy anhydride and 1140 g of chloroform to 28.4 g of the 50 wt % of a polyurethane solution obtained in Example 12(A) and stirring for 10 minutes, 1.6 g of "Jefermine D-2000" and 0.4 ml of triethylamine were added and polymerized by being stirred at 25° C. for 5 hours, to obtain a starting polyamino acid urethane resin solution (resin concentration: 12%). 4.09 g of N,N-dimethyl-1,3-diamino-propane and 3.08 g of cysteamine were added to 265 g of the resin solution and stirred at 60° C. for 3 hours, to obtain a polyamino acid urethane solution.

After filtering under pressure the thus obtained polyamino acid urethane solution to remove insoluble matters, it was spun in the same manner as in Example 14. The resultant fiber was washed with three times each time with 300 ml of water repeatedly, then dried and stretched by 1.7 times to obtain a polyamino acid urethane fiber.

It has been found that the resultant polyamino acid urethane fiber was excellent both in the feeling and the brushing property, exhibited a dyeability to a dense color, had a permanent wave effect of 4.2 and had excellent performance when it was used as the artificial hair.

EXAMPLE 17

164 g of L-glutamic acid-γ-methyl N-carboxy anhydride, 970 g of chloroform and 1.3 ml of triethylamine were added to 55.5 g of the 25 wt % polyurethane solution obtained in Example 12(B), polymerized by being stirred at 25° C. for 5 hours, to obtain a solution of the starting polyamide acid urethane resin (resin concentration: 12%). 4.09 g of N,N-dimethyl-1,3-diamino-propane and 3.08 g of cysteamine were added to 265 g of the resin solution and stirred at 60° C. for three hours, to obtain a polyamino acid urethane resin.

After filtering under pressure the thus obtained polyamino acid urethane resin to remove insoluble matters, it was treated in the same procedures as those in Example 16, to obtain a polyamino acid urethane fiber.

It has been found that the resultant polyamino acid urethane fiber was excellent both in the feeling and the brushing property, exhibited a dyeability to a dense color, had a permanent wave effect of 4.0 and an excellent performance when it was used as the artificial hair.

EXAMPLE 18

314 g of L-glutamic acid-γ-methyl N-carboxy anhydride, 2251 g of 1,2-dichloroethane and 2.5 ml of triethylamine were added to 640 g of the 25 wt % polyurethane solution obtained in Example 12(B), and polymerized by being stirred at 25° C. for 5 hours, to obtain a solution of the starting polyamino acid urethane resin (resin concentration: 12%). The resin solution was spun by the method shown in Example 6. 1.8 g of the fiber stretched by 1.8 times was wound around and set to a frame, which was immersed in 50 ml of methanol, 7.5 g of N,N-dimethyl-1,3-diaminopropane and 7.5 g of cysteamine at 60° C. for 30 hours to apply amidation. The fiber was washed twice each time with 30 ml of methanol repeatedly and then dried.

It has been found that the resultant polyamino acid urethane fiber was excellent both in the feeling and the brushing property, exhibited a dyeability to a dense color, had a permanent wave effect of 4.4 and an excellent performance when it was used as the artificial hair.

EXAMPLE 19

After adding 337 g of L-glutamic acid-γ-methyl N-carboxy anhydride, 39.7 g of L-leucine-N-carboxy anhydride and 2280 g of 1,2-dichloroethane to 56.8 g of the 50 wt % polyurethane solution obtained in Example 12(A) and stirring for 10 min, 3.2 g of "Jefermine D-2000" and 0.9 ml of triethylamine were added and polymerized by being stirred at 25° C. for 5 hours, to obtain a solution of the starting polyamino acid urethane resin (resin concen-tration: 12%). The resin solution was spun, stretched, subjected to amidation, washed and dried in the same procedures as those in Example 6.

It has been found that the resultant polyamino acid urethane fiber was excellent both in the feeling and the brushing property, exhibited a dyeability to a dense color, had a permanent wave effect of 3.9 and had an excellent performance when it was used as the artificial hair.

EXAMPLE 20

294 g of L-glutamic acid-γ-methyl N-carboxy anhydride, 34.7 g of N-leucine-N-carboxy anhydride, 1940 g of 1,2-dichloroethane and 2.6 ml of triethylamine were added to 111 g of the 25 wt % polyurethane solution obtained in Example 12(B), and polymerized by being stirred at 25° C. for 5 hours, to obtain a solution of a starting polyamino acid urethane resin (resin concentration: 12%). The resin solution was treated in the same manner as in Example 8, to obtain a polyamino acid urethane fiber.

It has been found that the resultant polyamino acid urethane fiber was excellent both in the feeling and the brushing property, exhibited a dyeability to a dense color, had a permanent wave effect of 3.9 and an excellent performance when it was used as the artificial hair.

Since the poly-α-amino acid derivative according to the present invention is similar, though it is a synthetic polymer, to protein in view of the chemical structure, its fibrous molding product shows more natural physical property, for example, with respect to the feeling heat resistance and toughness. Further, since the poly-α-amino acid derivative carries the amino groups, it is dyeable with an acidic acid in the same way as the natural protein. Further, since it carries the mercapto or disulfide groups, shape retainability can be provided by intermolecular re-crosslinking through the redox reaction. Accordingly, the poly-α-amino derivative can provide an excellent artificial hair.

Further, the polyamino acid urethane fiber according to the present invention is also chemically similar, though it is a synthetic fiber, to a natural protein fiber and has natural toughness, color and gloss since it mainly com-rises a poly-α-amino acid. Further, the fiber has a soft and flexible property derived from the polyurethane ingredient, as well as it is excellent in view of feeling, touch and brushing property. Furthermore, since it carries the amino groups on the side chains of the polymer, it is dyeable with an acidic dye quite in the same manner as the natural protein fiber. Furthermore, since it carries the mercapto or disulfide groups on the side chains of the polymer, it has a shape retainability due to the intermolecular re-crosslinkings through redox reaction. Accordingly, it can provide an excellent artificial hair.

What is claimed is:

1. An artificial hair made of a polyamino acid urethane fiber comprising a copolymer of a diol-diisocyanate polyurethane and an amino acid N-carboxy anhydride, in which the copolymer is subjected an amidation reaction with an organic diamine of formula (10) and an organic amine having a mercapto group or a disulfide group of formula (11) or (12) and shaped into a fibrous form:

$$HR^1N(CH_2)_nNR^2R^3 \quad (10)$$

where n represents an integer of 1 to 4 and $R^1$, $R^2$ and $R^3$ each represents H or an alkyl group with 1 to 4 carbon atoms, $$HR^1N(CH_2)_mSH \quad (11)$$

where m represents an integer of 1 to 4 and $R^1$ represents H or an alkyl group with 1 to 4 carbon atoms, $$HR^1N(CH_2)_mSS(CH_2)_nNR^2R^3 \quad (12)$$

where m and n each represents an integer of 1 to 4 and $R^1$, $R^2$ and $R^3$ each represents H or an alkyl group with 1 to 4 carbon atoms.

2. An artificial hair as defined in claim 1, wherein the polyamino acid urethane fiber is prepared by subjecting the copolymer to the amidation reaction with the organic diamine represented by the general formula (10) and the organic amine represented by the general formula (11) or (12) and then shaping the reaction product into a fibrous form.

3. An artificial hair as defined in claim 1, wherein the polyamino acid urethane fiber is prepared by shaping the copolymer into a fibrous form and then subjecting the thus obtained fiber to the amidation reaction with the organic diamine represented by the general formula (10) and the organic amine represented by the general formula (11) or (12).

4. A polyamino acid urethane fiber as defined in claim 2, wherein the polyurethane has amino groups on both terminal ends.

5. A polyamino acid urethane fiber as defined in claim 2, wherein the polyurethane has isocyanate groups on both terminal ends.

6. A polyamino acid urethane fiber as defined in claim 2, wherein the aminio acid N-carboxy anhydride is an acidic amino acid ω-alkyl N-carboxy anhydride.

7. A polyamino acid urethane fiber as defined in claim 2, wherein the amino acid N-carboxy anhydride comprises an acidic amino acid ω-alkyl N-carboxy anhydride and the neutral amino acid N-carboxy anhydride.

8. A polyamino acid urethane fiber as defined in claim 3, wherein the polyurethane has amino groups on both terminal ends.

9. A polyamino acid urethane fiber as defined in claim 3, wherein the polyurethane has isocyanate groups on both terminal ends.

10. A polyamino acid urethane fiber as defined in claim 3, wherein the amino acid N-carboxy anhydride is an acidic amino acid ω-alkyl N-carboxy anhydride.

11. A polyamino acid urethane fiber as defined in claim 3, wherein the amino acid N-carboxy anhydride comprises an acidic amino acid ω-alkyl N-carboxy anhydride and the neutral amino acid N-carboxy anhydride.

* * * * *